US006779871B1

(12) United States Patent
Seto et al.

(10) Patent No.: US 6,779,871 B1
(45) Date of Patent: Aug. 24, 2004

(54) INKJET RECORDING HEAD AND INKJET RECORDING DEVICE

(75) Inventors: Shinji Seto, Ebina (JP); Shigeru Umehara, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/690,619

(22) Filed: Oct. 23, 2003

(30) Foreign Application Priority Data

Mar. 24, 2003 (JP) ..... 2003-80948

(51) Int. Cl.[7] ..... B41J 2/145; B41J 2/15; B41J 2/14; B41J 2/16

(52) U.S. Cl. ..... 347/40; 347/47

(58) Field of Search ..... 347/40, 47, 41

(56) References Cited

U.S. PATENT DOCUMENTS 5,757,400 A * 5/1998 Hoisington ..... 347/40

6,488,355 B2 * 12/2002 Nakamura et al. ..... 347/40

FOREIGN PATENT DOCUMENTS

JP A 10-217452 8/1998
JP A 2001-334661 12/2001

* cited by examiner

*Primary Examiner*—Thinh Nguyen
(74) *Attorney, Agent, or Firm*—Oliff & Berridge, PLC

(57) ABSTRACT

Nozzle groups are arranged in a staggered pattern such that dead space does not occur. However, gaps are opened up between actuator units so that the actuator units can be joined to flow channel units. Further, piezoelectric elements are formed at each of the actuator units, and thus piezoelectric plates are consequently shorter. Therefore, when an inkjet recording head is lengthened, there is no need to form the piezoelectric elements by processing from a single long piezoelectric plate, implementation with a plurality of short piezoelectric plates is possible, and thus production yields do not deteriorate. Further, as the actuator units can be associated and arranged in a staggered pattern, an increase in width of the inkjet recording head can be minimized.

23 Claims, 12 Drawing Sheets

112

INKJET RECORDING HEAD AND INKJET RECORDING DEVICE

CROSS-REFERENCE TO RELATED APPLICATION

This application claims priority under 35 USC 119 from Japanese Patent Application No. 2003-80948, the disclosures of which are incorporated by reference herein.

BACKGROUND OF THE INVENTION

1. Field of the Invention

The present invention relates to an inkjet recording head and an inkjet recording device.

2. Description of the Related Art

An inkjet recording device records text, images and the like on recording paper by reciprocating an inkjet recording head in a main scanning direction, conveying the recording paper in a sub-scanning direction, and selectively discharging ink droplets from a plurality of nozzles. A technology is well known in which an inkjet recording head discharges an ink droplet from a nozzle that communicates with a pressure chamber by applying pressure, via an oscillating diaphragm, to ink in the pressure chamber by using an actuator such as, for example, a piezoelectric element which converts electrical energy to mechanical energy.

In recent years, the trend for inkjet recording devices to get faster has intensified. Accordingly, inkjet recording heads which are capable of image formation over broader regions in shorter times have been produced by lengthening the inkjet recording heads, increasing the number of nozzles at each inkjet recording head, and arraying the nozzles in matrix patterns (see, for example, Japanese Patent Application Laid-Open (JP-A) No. 2001-334661).

When an inkjet recording head is lengthened and the nozzles are increased in number and arrayed in a matrix pattern as described above, a large number of piezoelectric elements arrayed in the matrix pattern are also required in accordance therewith. This large number of piezoelectric elements arrayed in the matrix pattern are formed by machining, for example, by sandblasting, a single piezoelectric plate (i.e., by machining a piezoelectric material such as a piezoelectric ceramic plate or the like, prior to preparation of the piezoelectric elements). Therefore, the longer the inkjet recording head, the longer the piezoelectric plate for forming the piezoelectric elements. However, making the piezoelectric plate longer and forming the large number of piezoelectric elements arrayed in the matrix pattern is problematic for manufacturing, and leads to a decrease in yields.

Accordingly, a technique has been considered in which a plurality of actuator units, at which the piezoelectric elements are formed, are connected in a row direction of the nozzles for lengthening. With such a structure, the large number of piezoelectric elements are formed so as to be divided up between a plurality of piezoelectric plates. In consequence, the decrease in yields does not result.

However, in a case in which a plurality of actuator units are thus joined for lengthening, problems may arise in assembly if there is no spacing at joining portions thereof. Accordingly, there is a technique in which a plurality of parallelogram-form actuator units are offset in the main scanning direction and a spacing L between the actuator units is assured (see, for example, JP-A No. 10-217452).

However, it is necessary to dispose the parallelogram-form actuator units to be offset in the main scanning direction in order to assure the spacing L between the actuator units. Consequently, the width in the main scanning direction of the inlkjet recording head in which the actuator units are joined becomes larger in accordance with lengthening of the inkjet recording head (see FIG. 1 of JP-A No. 10-217452). As a result, the inkjet recording head becomes larger together with the length of the inkjet recording head.

SUMMARY OF THE INVENTION

The present invention has been devised in order to solve the problems described above, and an object of the present invention is to lengthen an inkjet recording head while assuring assembly characteristics and not increasing width of the inkjet recording head, and without causing a deterioration in yield.

In a first aspect of the present invention, an inkjet recording head which scans in a direction intersecting a conveyance direction of a recording medium and records an image at the recording medium with ink drops ejected from nozzles includes: a nozzle plate in which the nozzles which eject the ink drops are formed; pressure chambers communicating with the nozzles; actuators abutting at the pressure chambers, which at least one of increase and reduce pressures of ink in the pressure chambers; and a plurality of nozzle rows parallel to the conveyance direction of the recording medium. This inkjet recording head includes at least two nozzle groups which are grouped over a plurality of the nozzle rows, and each nozzle group is offset, relative to a neighboring nozzle group, in a direction intersecting a row direction of the nozzle rows such that the nozzle groups are arranged in a staggered form, and the numbers of nozzles in the nozzle rows of each nozzle group decrease in the direction intersecting the row direction, from the nozzle row at a side furthest from the neighboring nozzle group to the nozzle row at a side closest to the neighboring nozzle group.

According to an inkjet recording head of the present aspect, the at least two nozzle groups, which are grouped traversing the plurality of nozzle rows, are included. The nozzle groups are disposed in a staggered pattern and separated from one another in the direction intersecting the row direction of the nozzle rows. The number of nozzles in each nozzle row becomes smaller in accordance with progress from a first of the nozzle rows to a last of the nozzle rows along the direction in which the nozzle groups are separated from one another. Thus, gaps can be formed between the nozzle groups.

Because the gaps can be formed between the nozzle groups, if actuator units are formed by machining for each nozzle group and these actuator units are joined to produce the inkjet recording head, there is not a problem with assembly.

Further, these actuator units are formed by machining a plurality of short actuator plates (an actuator material prior to machining of the actuators), which oppose the nozzle groups. Thus, in contrast to long piezoelectric plates, a deterioration in production yields does not result.

Furthermore, the nozzle groups are arranged in the staggered pattern and the nozzle groups are only offset forwards and backwards in the scanning direction of the inkjet recording head. Thus, if the actuators are increased in number in accordance with lengthening of the inkjet recording head, the width of the inkjet recording head will not increase therewith.

In a second aspect of the present invention, an inkjet recording head which records an image over a width of a recording medium, which is being conveyed, with ink drops ejected from nozzles includes: a nozzle plate in which the nozzles which eject the ink drops are formed; pressure chambers communicating with the nozzles; actuators abutting at the pressure chambers, which at least one of increase and reduce pressures of ink in the pressure chambers; and a plurality of nozzle rows in a direction intersecting the conveyance direction of the recording medium. This inkjet recording head includes at least two nozzle groups which are grouped over a plurality of the nozzle rows, and each nozzle group is offset, relative to a neighboring nozzle group, in a direction intersecting a row direction of the nozzle rows such that the nozzle groups are arranged in a staggered form, and the numbers of nozzles in the nozzle rows of each nozzle group decrease in the direction intersecting the row direction, from the nozzle row at a side furthest from the neighboring nozzle group to the nozzle row at a side closest to the neighboring nozzle group.

According to the present aspect, the same effects as in the first aspect described above are obtained. Further, the inkjet recording head is fixed but can record images over the width of the recording medium that is being conveyed. Thus, an inkjet recording head capable of high-speed printing can be provided.

In a third aspect of the present invention, when viewed in the row direction of the nozzle rows, the nozzles of the nozzle groups are disposed to line up in the row direction.

According to the present aspect, the nozzle groups overlap if viewed in the row direction of the nozzle rows. Thus, the width of the inkjet recording head does not increase as in a conventional example (the structure in FIG. 1 of JP-A No. 10-217452).

In a fourth aspect of the present invention, arrangement forms of the nozzles of the nozzle groups include, when straight lines are taken between the nozzles disposed at outer edges of the nozzle groups, at least one of a triangular form and a trapezoid form.

In a fifth aspect of the present invention, arrangement forms of the nozzles of the nozzle groups are such that the nozzle groups include a combination of forms including a plurality of nozzle groups with the at least one of a triangular form and a trapezoid form.

In a sixth aspect of the present invention, actuator units, which are structured to include at least the pressure chambers and actuators respectively corresponding to the nozzles constituting the nozzle groups, are included one at each nozzle group.

According to the present aspect, the actuator units described above are provided one for each nozzle group, and actuator characteristics tests for predicting ink drop discharge characteristics can be carried out on each actuator unit. Thus, the occurrence or absence of failures at each actuator unit, characteristics thereof and the like can be found out by carrying out the actuator characteristics tests on each actuator unit prior to assembly. Therefore, by appropriately selecting the actuator units, co-ordinating the characteristics of the actuator units and assembling the same, ink droplet discharge characteristics of the inkjet recording head can be made uniform.

In a seventh aspect of the present invention, each nozzle group is provided with an ink discharge unit including at least the nozzle plate and the actuator unit.

According to the present aspect, each nozzle group is provided with the ink discharge unit with the structure described above. Hence, ink droplets can be discharged at the ink discharge units. Further, because, as mentioned above, the gaps are formed between the nozzle groups, the ink discharge units can be associated in the staggered form to structure the inkjet recording head. Thus, the inkjet recording head can be lengthened without increasing the width of the inkjet recording head. Moreover, in cases in which problems arise, the ink discharge units can be individually replaced.

In an eighth aspect of the present invention, the actuators include piezoelectric elements for converting electrical energy to mechanical energy.

In a ninth aspect of the present invention, the actuators include heatgenerating resistors which pressurize the ink in the pressure chambers by heating and causing bubbling.

In a tenth aspect of the present invention, an inkjet recording device employs an inkjet recording head included in the aspects described hereabove.

Because an inkjet recording device based on the present aspect employs an inkjet recording head included in the aspects described above, the width of the inkjet recording head is not increased, and the inkjet recording device is not made larger.

DETAILED DESCRIPTION OF THE INVENTION

Figure 1A:
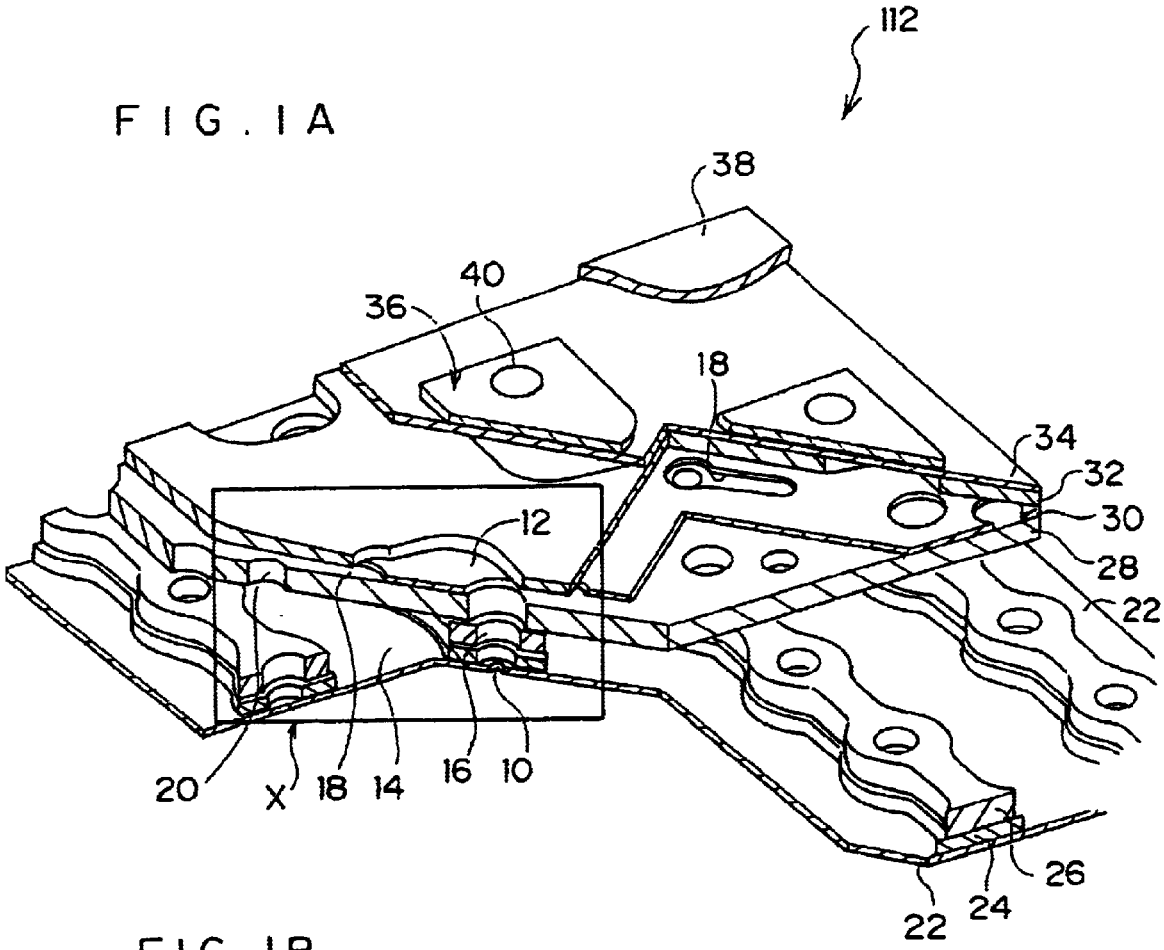
FIG. 1A is a sectional perspective view showing principal elements of an inkjet recording head relating to one embodiment of the present invention.

Herebelow, a first embodiment of an inkjet recording head relating to the present invention will be described with reference to FIGS. 1 to 6.

As shown in FIGS. 1A, 1B, 2A and 2B, an inkjet recording head 112 is provided with a nozzle 10, a pressure chamber 12, and a common ink chamber 14. The nozzles 10, arranged in a matrix pattern, discharge ink drops, which is described later. The pressure chamber 12 applies pressure to the ink and causes discharge of the ink droplets from the nozzle 10. A shape of the pressure chamber 12 as viewed from a direction of discharge of the ink droplets is formed in a diamond shape. The common ink chamber 14 is charged with ink which is introduced from an unillustrated ink supply section. The inkjet recording head 112 is further provided with a communication chamber 16 and a supply channel 18. The communication chamber 16 communicates between the nozzle 10 and the pressure chamber 12. The supply channel 18 communicates between an opening portion 20 of the common ink chamber 14 and the pressure chamber 12. Further, a diaphragm 34 is fixed at an upper face of the pressure chamber 12. A piezoelectric element 36 is fixed at an upper face of the diaphragm 34. A shape of the piezoelectric element 36 as viewed from the direction of discharge of the ink droplets is a substantially rectangular shape. Further still, a wiring substrate 38 is connected to an upper face of the piezoelectric element 36 via a ball solder 40.

Figure 2A:
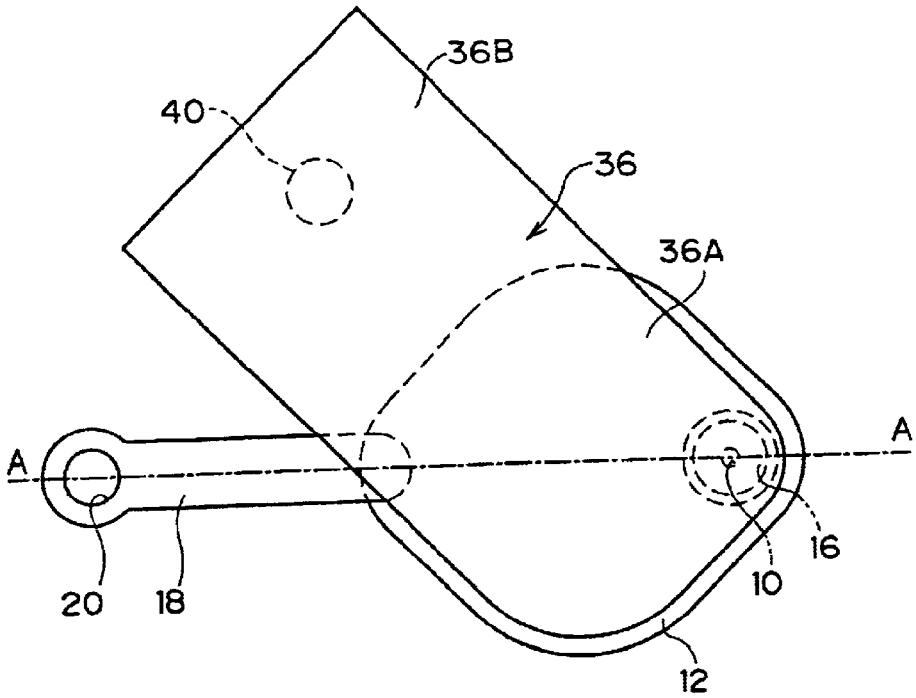
FIG. 2A is a sectional view showing principal elements of the inkjet recording head relating to the one embodiment of the present invention.

As is shown in FIG. 2A, the nozzle 10 is located at a corner portion of the diamond shape of the pressure chamber 12, and the supply channel 18 communicates with a corner portion which is opposite the position of the nozzle 10 along a diagonal of the pressure chamber 12.

The piezoelectric element 36 is divided into a driving portion 36A and an electrode pad portion 36B. The driving portion 36A is a portion which is disposed at an upper face of a region corresponding to the pressure chamber 12, with the diaphragm 34 interposed therebetween. The driving portion 36A has a size slightly smaller than the pressure chamber 12 and is substantially the same shape as the pressure chamber 12. The driving portion 36A distorts, and applies pressure to the ink in the pressure chamber 12 via the diaphragm 34.

The electrode pad portion 36B is a portion which extends from the driving portion 36A to outside the area of the pressure chamber 12. The electrode pad portion 36B is connected with the wiring substrate 38 via the ball solder 40.

Figure 2B:
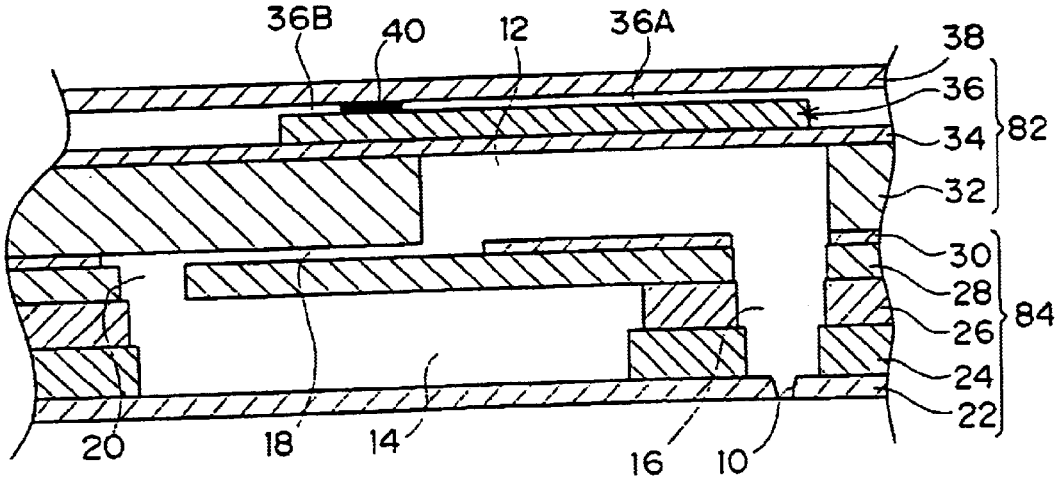
FIG. 2B is a sectional view of the principal elements of the inkjet recording head of FIG. 2A when cut along the line A—A of FIG. 2A.
Figure 5:
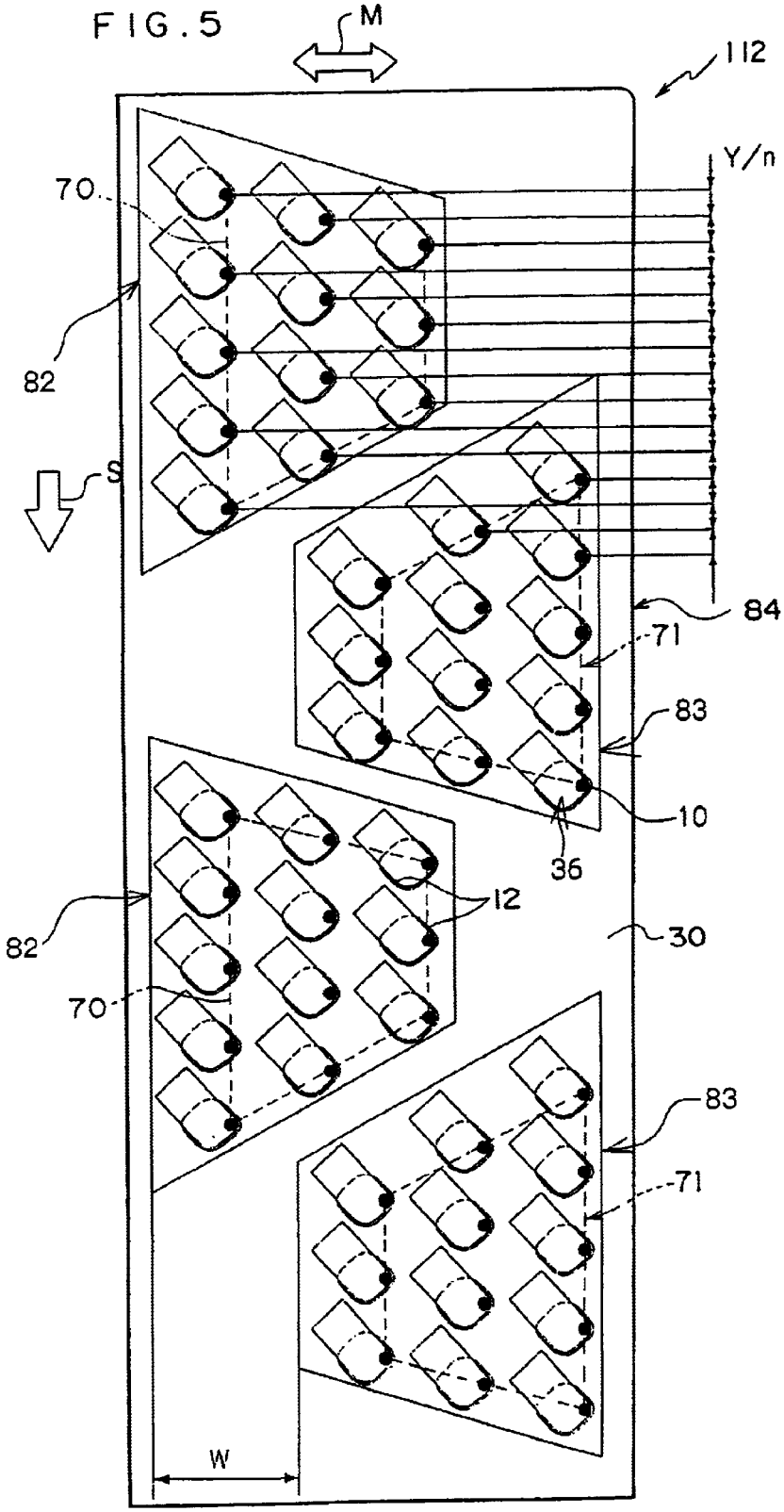
FIG. 5 is a schematic view in which nozzle groups and actuator units of the inkjet recording head relating to the one embodiment of the present invention are arranged in a staggered form.
Figure 12:
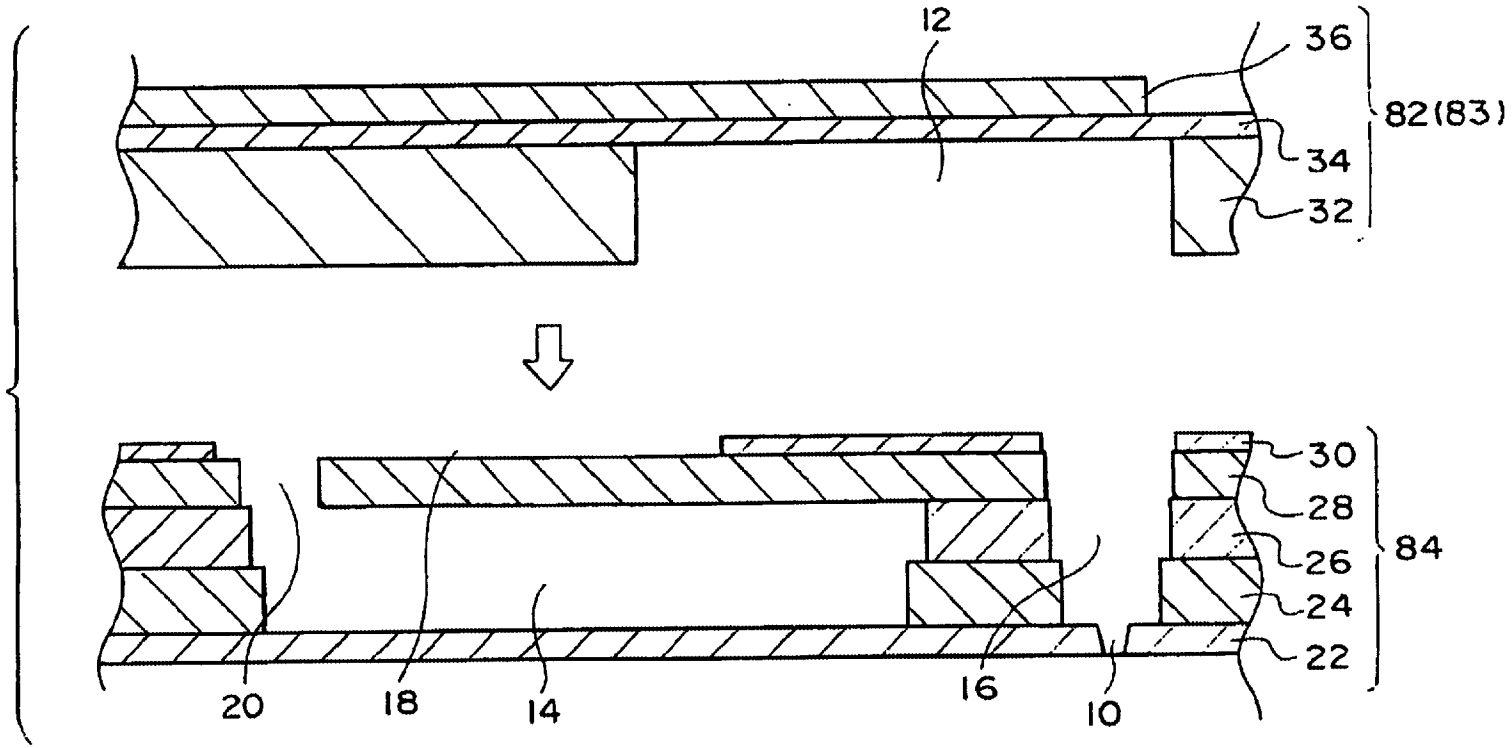
FIG. 12 is a view schematically showing joining of a flow channel unit and an actuator unit.

As is shown in FIG. 5, the nozzles 10 form parallelogram-form nozzle groups 70. As shown in FIG. 12 (a situation prior to joining), a flow channel unit 84 is structured by the communication chambers 16, the supply channels 18 and the common ink chambers 14, which are provided in respective correspondence with the nozzles 10. Actuator units 82 and 83 are structured by the pressure chambers 12, the diaphragms 34 and the piezoelectric elements 36, which are provided in respective correspondence with the nozzles 10 of each of the nozzle groups 70 and 71. Hence, the flow channel unit 84 and the actuator units 82 and 83 are joined, are connected with the wiring substrate 38 via the ball solder 40 as shown in FIG. 2B, and are assembled to an unillustrated ink supply section and the like to form the inkjet recording head 112.

Next, a process for production of the inkjet recording head 112 of the present embodiment will be described.

First, a process for production of the flow channel unit 84 will be described.

As shown in FIG. 12, a nozzle plate 22, ink pooling plates 24 and 26, a through plate 28 and an ink supply channel plate 30 are laminated, in this order, and joined. The nozzle 10 is formed in the nozzle plate 22. The ink pooling plates 24 and 26 contribute to formation of the communication chamber 16 and the common ink chamber 14. The through plate 28 contributes to formation of the communication chamber 16 and the opening portion 20 of the common ink chamber 14. The supply channel 18 is formed in the ink supply channel plate 30.

Then, a front face of the nozzle plate 22 is covered with a water-repellent coating layer and the nozzles 10 are opened by an excimer laser.

A material of the nozzle plate 22 is a polyimide, and materials of the ink pooling plate 24, the ink pooling plate 26, the through plate 28 and the ink supply channel plate 30 are SUS. As mentioned above, the component in which these plates are laminated and joined is the flow channel unit 84.

Figure 11:
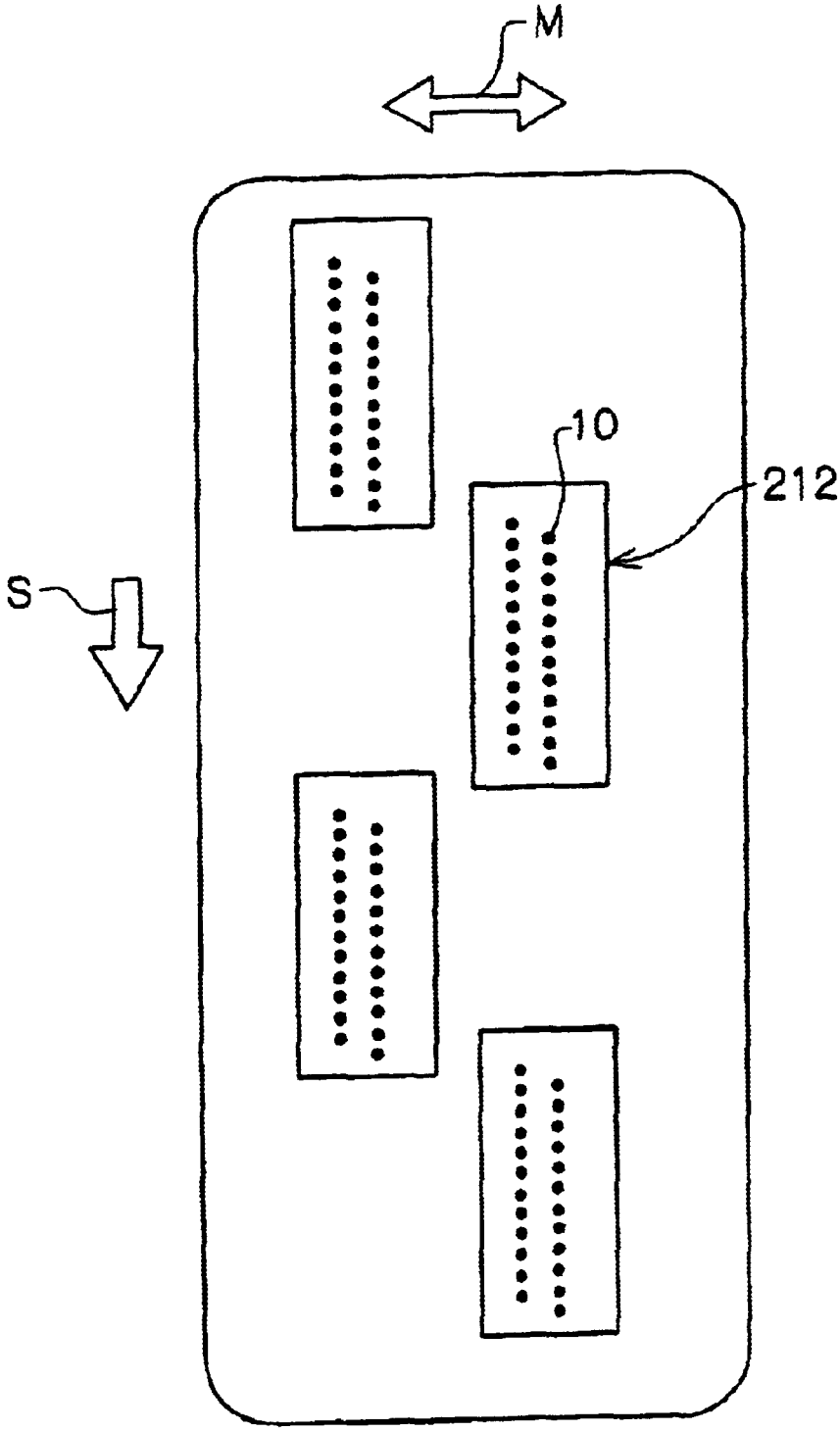
FIG. 11 is a view in which conventional inkjet recording heads are arranged in a staggered pattern.

An arrangement of the nozzles 10, which are arrayed in a matrix pattern, will now be described. As shown in FIGS. 3 and 4, the nozzles 10 are lined up with equal spacings, with a spacing Y in a direction S which intersects a main scanning direction M (see FIG. 11), which will be discussed later. Note that a line of the nozzles 10 in the direction S intersecting the main scanning direction M is a "row", and a line in the main scanning direction M is a "column". The rows of the nozzles 10 are lined up in n rows (five rows in FIGS. 3 and 4) which are equally spaced in the main scanning direction M with a spacing larger than the size of the pressure chambers 12. Each row of the nozzles 10 is successively offset in the direction S intersecting the main scanning direction M by a spacing Y/n, which is smaller than the size of the pressure chambers 12.

Figures 3A, 3B:
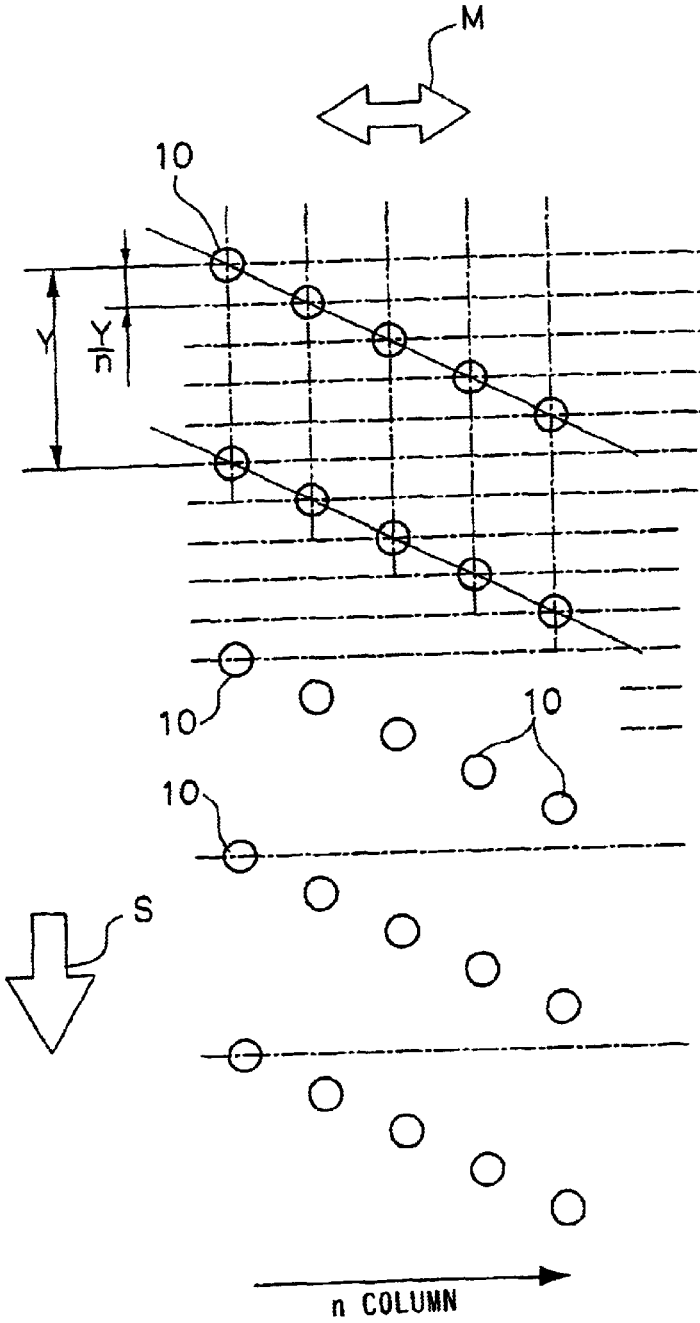
FIG. 3A and FIG. 3B are explanatory views for explaining a nozzle arrangement of the inkjet recording head relating to the one embodiment of the present invention.
Figure 4:
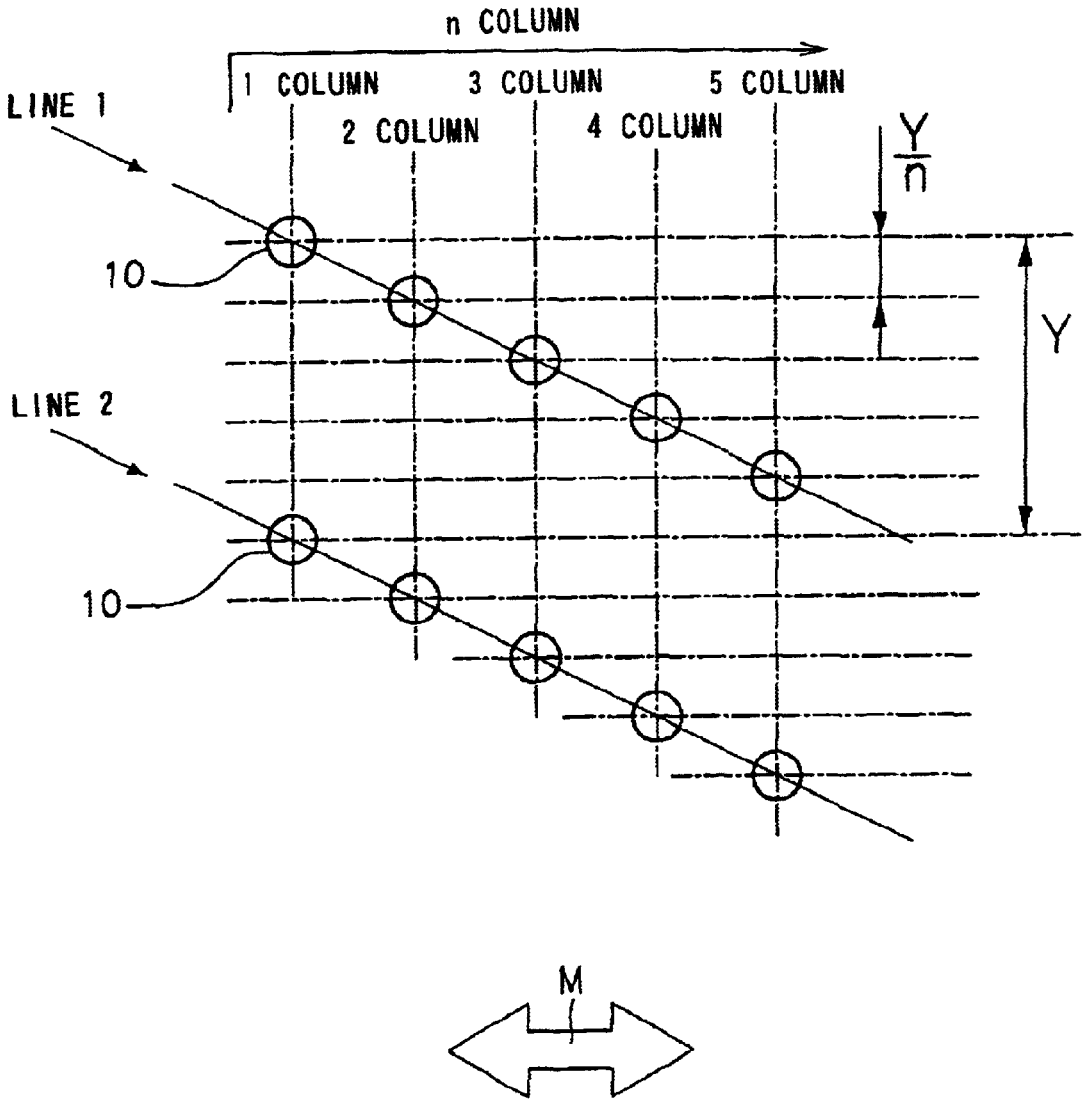
FIG. 4 is an enlarged view of FIG. 3A for explaining the nozzle arrangement of the inkjet recording head relating to the one embodiment of the present invention.

Accordingly, if projected in the main scanning direction M, the nozzles 10 are lined up with pitch Y/n as shown in FIG. 3B, and the inkjet recording head 112 with a high resolution can be realized. When the inkjet recording head 112 moves in the main scanning direction M, a straight row of dots can be formed on a recording paper P (see FIG. 11) by controlling the discharge timings of the ink droplets for each row of the nozzles 10.

In the present embodiment, as shown in FIG. 5, the nozzles 10 are constituted by four groups each of which includes twelve nozzles 10 in a form which, if the nozzles 10 disposed at outer edges of the group are joined by straight lines, is a trapezoid. These groups are the nozzle groups 70 and 71. The actuator units 82 and 83 are included one for each of the nozzle groups 70 and 71. That is, in the present embodiment, the inkjet recording head 112 is structured by assembling four of the actuator units 82 and 83 to one of the flow channel unit 84.

Figure 9:
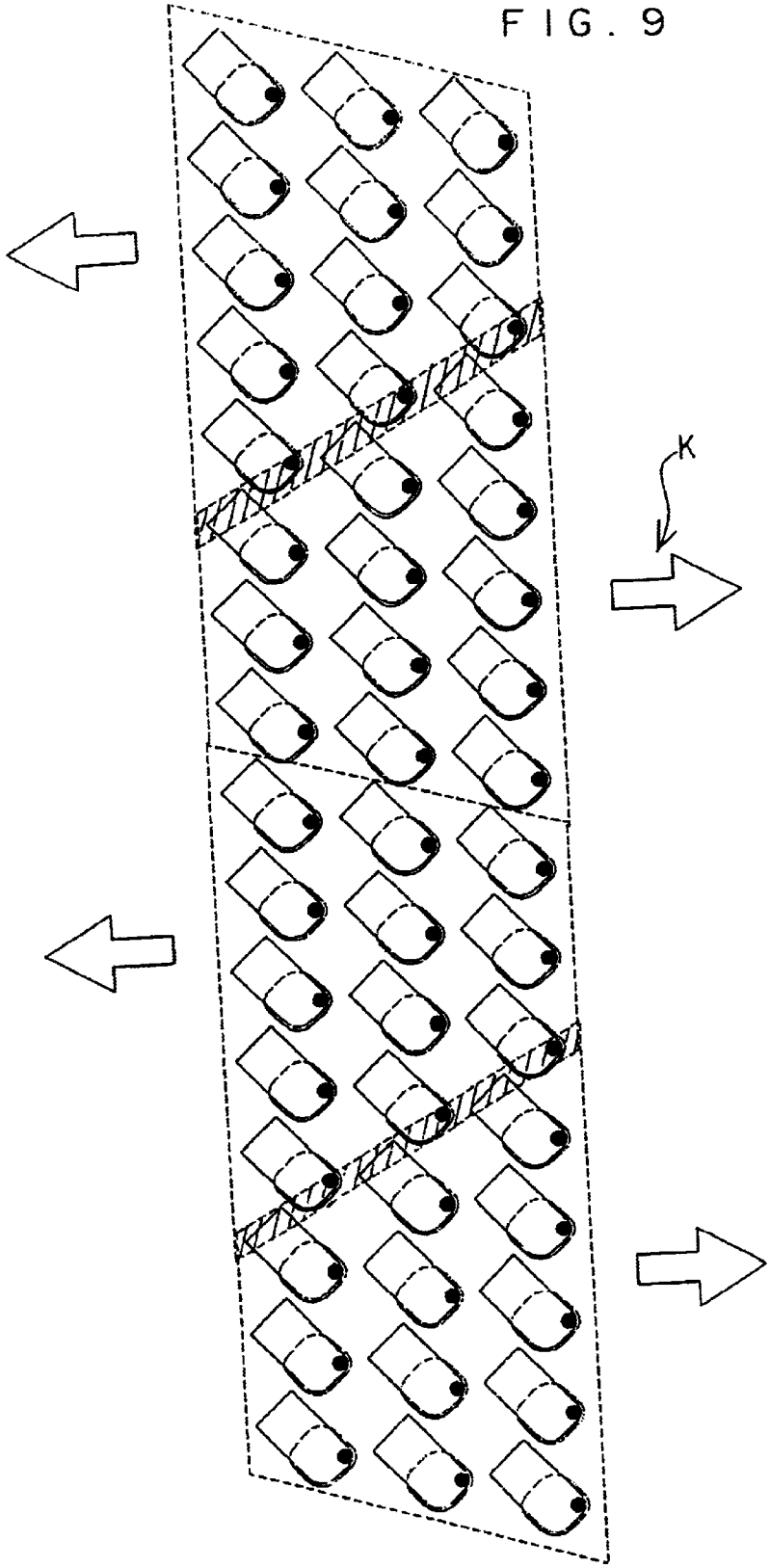
FIG. 9 is an explanatory view showing arrangements of nozzles and piezoelectric elements of a conventional inkjet recording head, and explaining how nozzle groups and actuator units (of the nozzle groups) of an inkjet recording head relating to an embodiment of the present invention are offset relative to a nozzle row direction to be arranged in a staggered form.
Figure 10B:
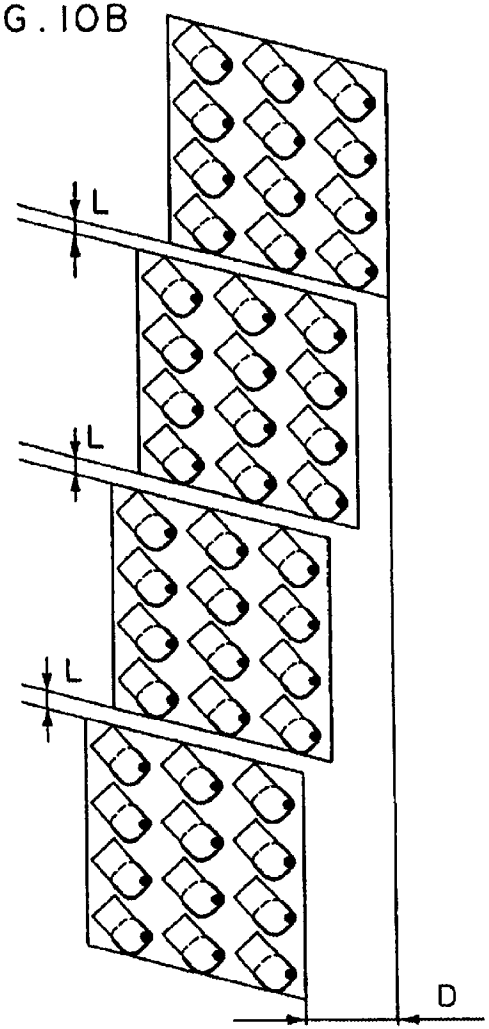
FIG. 10A and FIG. 10B are explanatory views for explaining that width of an inkjet recording head increases when gaps are provided between parallelogram-form actuator units by the actuator units being disposed to be offset.
Figure 10A:
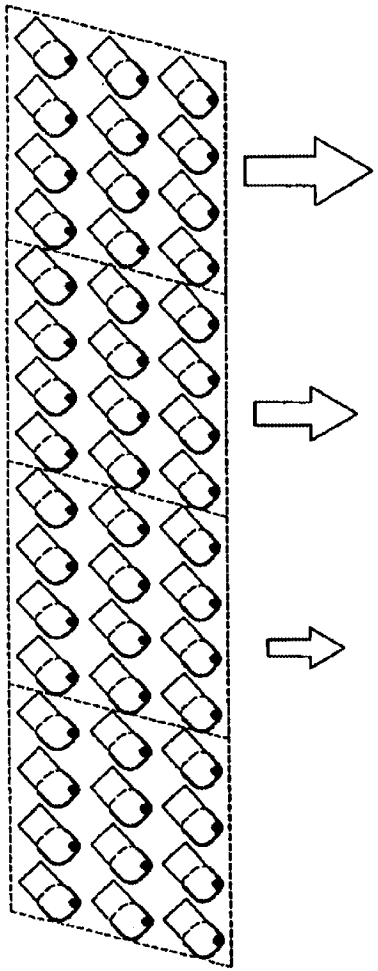

If four actuator units are simply put together, then, as shown in FIG. 9, the actuators cannot be spaced apart, and the areas marked with diagonal lines overlap and cannot be assembled. However, the actuator units 82 and 83 can be spaced apart and assembly without overlapping by disposing the nozzle groups 70 and 71, which are trapezoid as shown in FIG. 5, in a staggered pattern, that is, by offsetting the actuator units 82 and 83 in a staggered pattern as shown in FIG. 5. In other words, the actuator units 82 and 83 are assembled to the flow channel unit 84 in a staggered form. Even with the nozzles 10 arranged thus, a pitch spacing of the nozzles, projected in the main scanning direction M, is Y/n. Note that in a case of parallelogram-form actuator units as shown in FIG. 10A, arrangement in a staggered pattern would not be possible and, as shown at FIG. 10B, an arrangement which shifts in the main scanning direction would be unavoidable. Consequently, width in the main scanning direction of an inkjet recording head in which the actuator units were joined would become larger in accordance with lengthening of the inkjet recording head.

Next, a process for production of the actuator unit 82 will be described.

First, an unillustrated piezoelectric plate is adhered to an unillustrated fixation support by a removable adhesive, for example, a heat-foaming adhesive film which has a characteristic of foaming and greatly decreasing in adhesive strength when heated to a predetermined temperature after adhesion. Then the piezoelectric elements 36 arranged in the matrix pattern are prepared at the piezoelectric plate by using, for example, sandblasting.

As shown in FIG. 12, the diaphragm 34 is joined to a face of the piezoelectric element 36 which is opposite from a face of the piezoelectric element 36 at which the fixation support is disposed. A pressure chamber plate 32, in which the pressure chamber 12 is formed, is joined to this diaphragm 34. Materials of the pressure chamber plate 32 and diaphragm 34 are SUS.

First and second electrode layers, which serve as electrode layers, are formed beforehand at both faces of the piezoelectric element 36 by sputtering or the like. By joining the diaphragm 34 which is to be multi-functionally used as a common electrode, and the first electrode, with a conductive adhesive, the first electrode layer, i.e., the piezoelectric element 36, is electrically connected with the diaphragm 34.

Thereafter, the fixation support is heated, the adhesive power of the heat foaming adhesive film is reduced, and the fixation support is detached.

The component in which the piezoelectric element 36, the diaphragm 34 and the pressure chamber plate 32 are thus joined is referred to as the actuator unit 82 as described above.

As described above, that is, as shown in FIG. 5, there are four of the actuator units 82 and 83, corresponding to the nozzle groups 70 and 71. These four actuator units 82 and 83 are brought together and joined to the flow channel unit 84 to prepare the inkjet recording head 112. It is possible to join the four actuator units 82 and 83 to the flow channel unit 84 in this manner, because the nozzle groups 70 and 71 are arranged in the staggered form, as described above, and gaps are opened up between the actuator units 82 and 83.

Because these (for example, in twelve in the present embodiment) piezoelectric elements 36 are respectively formed at the four actuator units 82 and 83, the piezoelectric plates are short. Therefore, even if the inkjet recording head 112 is lengthened, there is no need for the piezoelectric elements 36 to be machined from a single long piezoelectric plate, and the inkjet recording head 112 can be implemented by four short piezoelectric plates. Consequently, production yields are not adversely affected.

Because the four actuator units 82 and 83 are associated and arranged in the staggered pattern, the inkjet recording head 112 is widened only by a width W shown in FIG. 5. Even if more than four of the actuator units 82 and 83 are joined, the width of the inkjet recording head 112 will not increase further.

Further still, after completion of the actuator units 82 and 83, tests of characteristics of the piezoelectric elements 36 for predicting ink drop discharge characteristics can be carried out on each of the actuator units 82 and 83. Thus, the occurrence or absence of failures at each actuator unit 82 or 83, characteristics thereof and the like can be found out before assembly to the flow channel unit 84. Therefore, by appropriately selecting the actuator units 82 and 83, coordinating the characteristics of the actuator units 82 and 83 and, assembling the same, ink droplet discharge characteristics of the inkjet recording head 112 can be made uniform.

Then, after the actuator units 82 and 83 have been associated and joined to the flow channel unit 84 as shown in FIG. 12, the wiring substrate 38, at which the ball solders 40 are formed one for each piezoelectric element 36, is joined to the piezoelectric elements 36 as shown in FIG. 2B. Because the first and second electrode layers are formed at the two faces of the piezoelectric element 36 as mentioned earlier, the second electrode layer, which is to say the piezoelectric element 36, is electrically connected with the wiring substrate 38. The wiring substrate 38 is further connected with the diaphragm 34 by a conductive member.

Finally, an unillustrated ink supply section and the like are assembled, and thus the inkjet recording head 112 of the present embodiment is completed.

Next, operation of the inkjet recording head 112 of the present embodiment will be described.

Figure 1B:
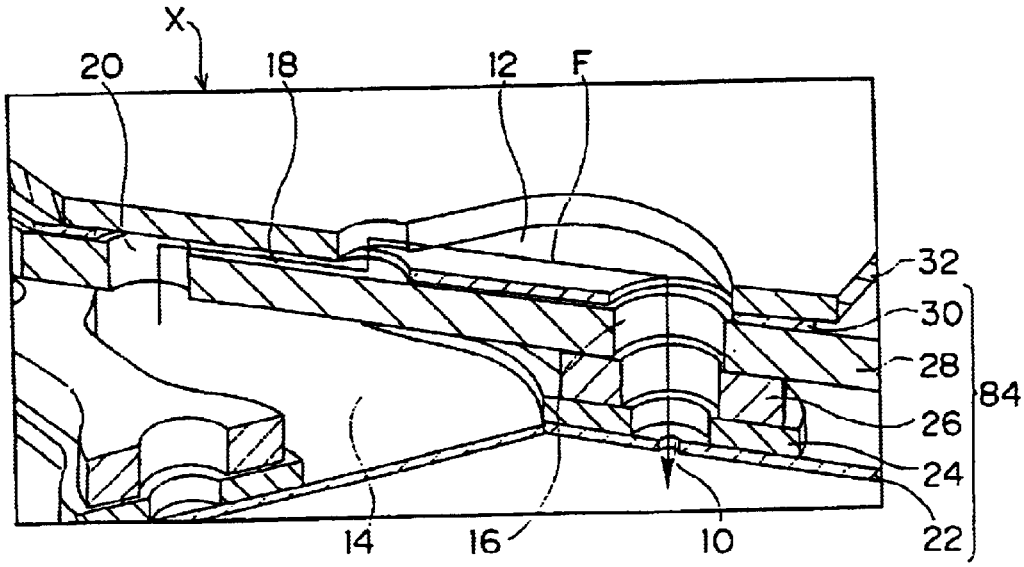
FIG. 1B is an enlarged view of portion X of FIG. 1A.

As shown by arrow F in FIG. 1B, ink introduced from the unillustrated ink supply section of the inkjet recording head 112 is charged into the common ink chamber 14. This ink is charged from the common ink chamber 14, through the supply channels 18, to each pressure chamber 12. In the state in which the ink has been charged into each pressure chamber 12, the driving portions 36A of the piezoelectric elements 36 are warped by, for example, passing current from the ball solders 40 to the piezoelectric elements 36. The ink in the pressure chambers 12 is pressurized via the diaphragms 34, and ink drops are discharged from the nozzles 10.

The nozzles 10 structure the nozzle groups 70 and 71, and the nozzle groups 70 and 71 are arranged in the staggered pattern. Accordingly, the four actuator units 82 and 83 are also arranged in the staggered pattern. Therefore, when the four actuator units 82 and 83 are associated and joined, gaps are opened up between the neighboring actuator units 82 and 83. Thus, problems with assembly do not arise. Furthermore, the width of the inkjet recording head 112 does not increase by more than the width W in FIG. 5.

Figure 6:
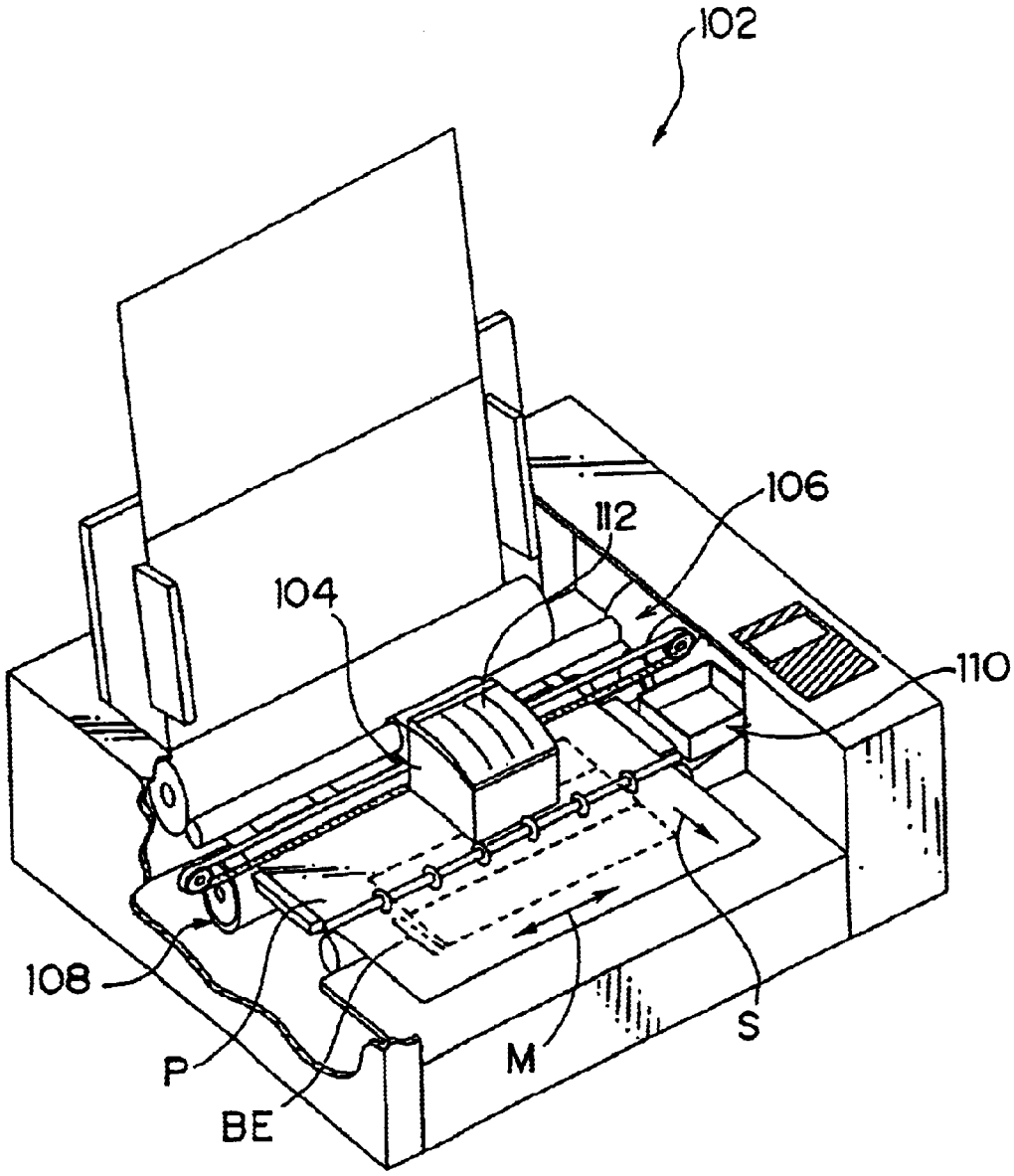
FIG. 6 is a view showing an inkjet recording device which employs the inkjet recording head relating to the one embodiment of the present invention.

Next, an inkjet recording device employing the inkjet recording head 112 of the first embodiment will be described. FIG. 6 shows an inkjet recording device 102 which is equipped with the inkjet recording head 112.

The inkjet recording device 102 is structured to include a carriage 104, a main scanning mechanism 106, a sub-scanning mechanism 108 and a maintenance station 110. The inkjet recording head 112 is mounted at the carriage 104. The main scanning mechanism 106 is for scanning the carriage 104 in the main scanning direction M. The sub-scanning mechanism 108 is for scanning a recording paper P, which serves as a recording medium, in the sub-scanning direction S.

The inkjet recording head 112 is mounted at the carriage 104 such that the nozzle plate 22 in which the nozzles 10 are formed (see FIGS. 1A to 2B) faces the recording paper P. By discharging ink droplets at the recording paper P while being moved in the main scanning direction M by the main scanning mechanism 106, the inkjet recording head 112 implements recording of an image at a certain band region BE. When one cycle of movement in the main scanning direction M has finished, the recording paper P is conveyed in the sub-scanning direction S by the sub-scanning mechanism 108, and the next band region BE is recorded while the carriage 104 is again moved in the main scanning direction M. Image recording can be carried out over the whole of the recording paper P by repeating these operations for a number of cycles.

The inkjet recording head 112 is equipped with the numerous nozzles 10 arranged in a matrix pattern as described above. Therefore, an image can be formed over a broad band region BE in one cycle of movement of the carriage 104 in the main scanning direction M. That is, image recording can be carried out over the whole face of the recording paper P with just a few movement cycles of the carriage 104. Thus, printing at high speed is possible.

When the inkjet recording head 112 moves in the main scanning direction M, the ink droplet discharge timings are offset for each row of the nozzles 10 and for each of the nozzle groups 70 and 71. Thus, it is possible to form a straight row of dots on the recording paper P.

Further, even though the inkjet recording head 112 is structured by the four actuator units 82 and 83, because the actuator units 82 and 83 are disposed in the staggered pattern, the width of the inkjet recording head 112 does not increase by more than the width W of FIG. 5. Accordingly, the inkjet recording device 102 is also not made larger.

Note that the present invention is not limited to the embodiment described above.

For example, in the embodiment described above, the nozzles 10 are arranged in a matrix pattern. However, it is sufficient merely that there are two or more rows.

Figure 7:
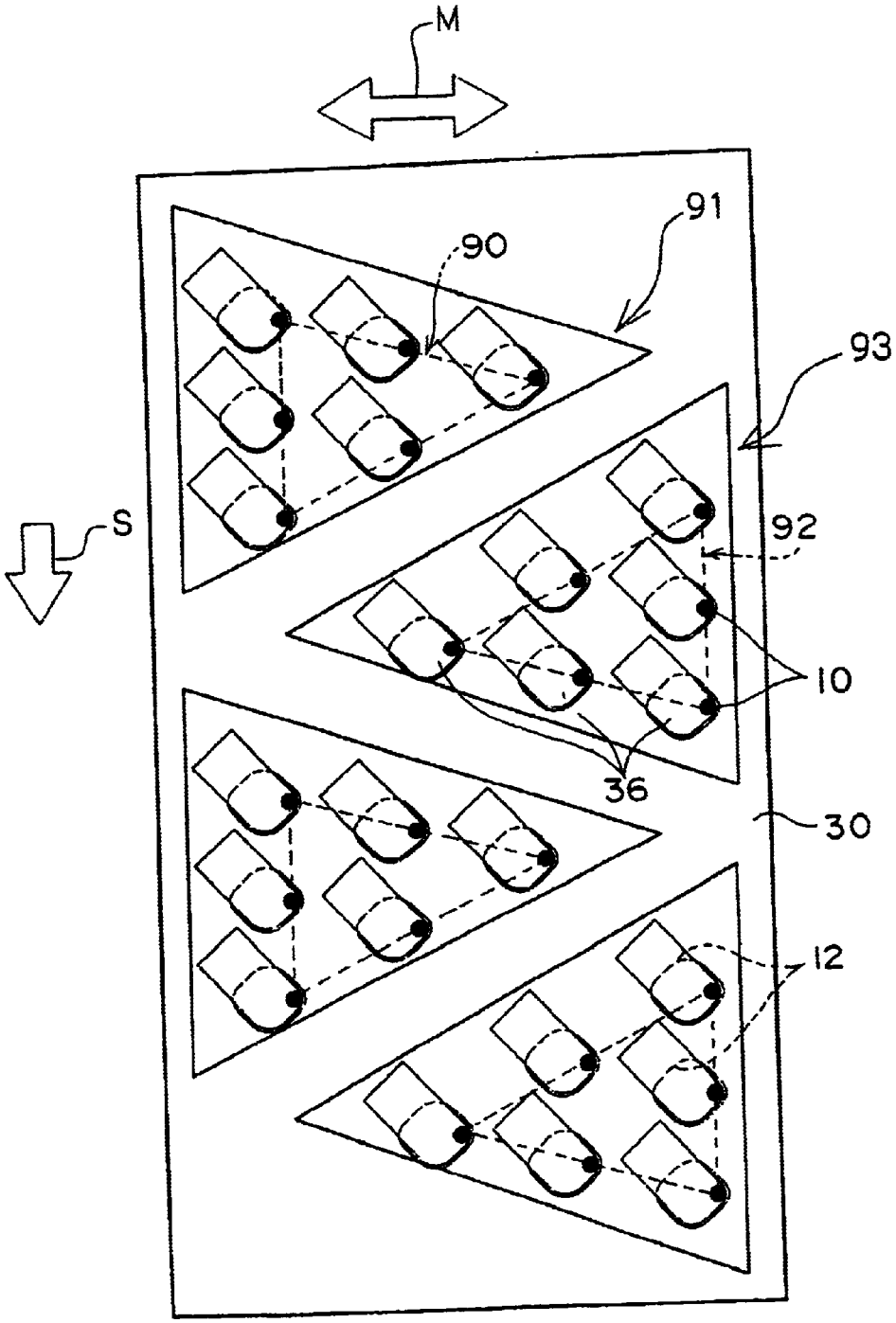
FIG. 7 is a schematic view showing an inkjet recording head relating to another embodiment of the present invention, in which arrangements of nozzles of nozzle groups and arrangements of piezoelectric elements in actuator units have triangular forms, and the actuator units (of the nozzle groups) are arranged in a staggered form.
Figure 8:
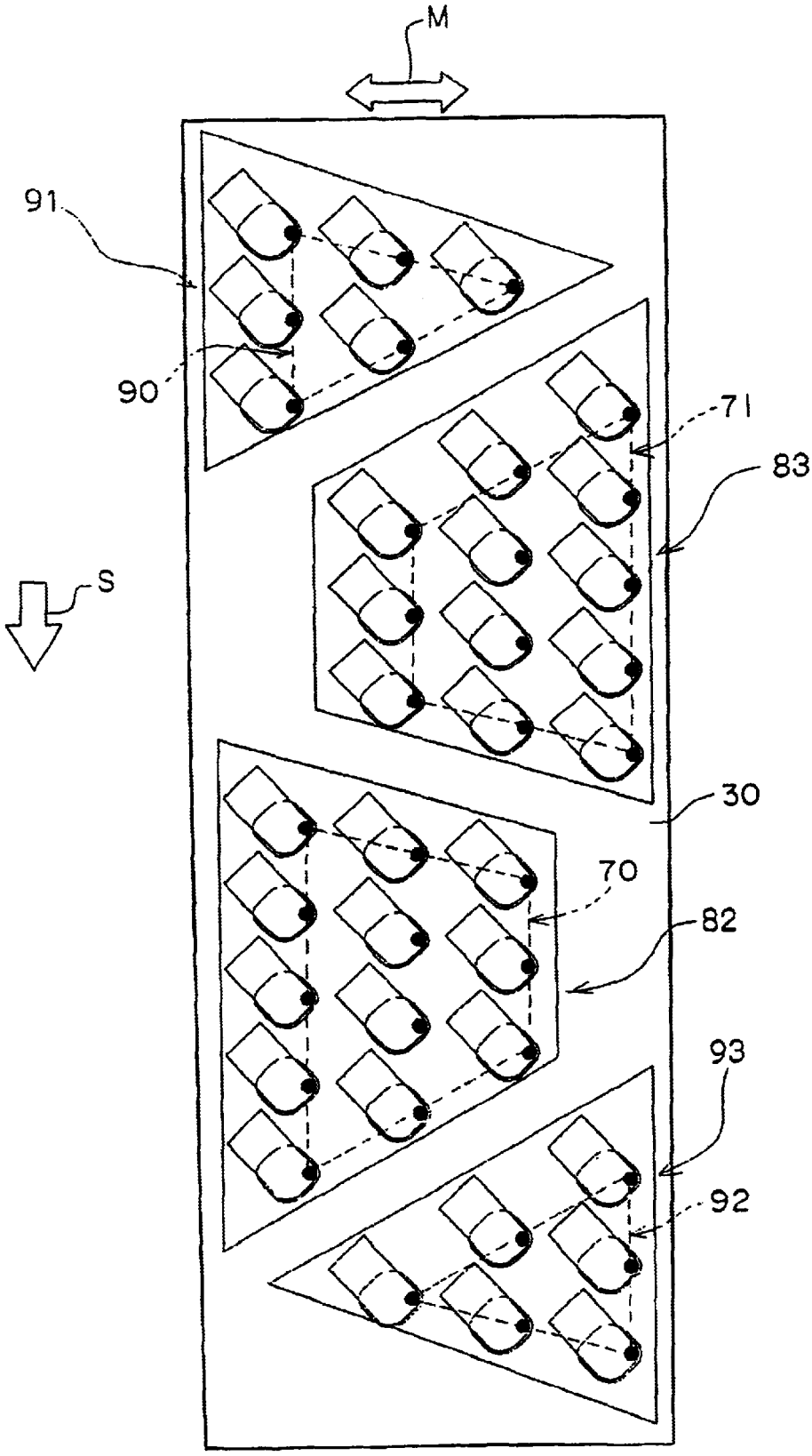
FIG. 8 is a schematic view showing an inkjet recording head relating to yet another embodiment of the present invention, in which arrangements of nozzles of nozzle groups and arrangements of piezoelectric element in actuator units have triangular forms and trapezoid forms, and the actuator units (of the nozzle groups) are arranged in a staggered form.

In the embodiment described above, the nozzle groups 70 and 71 and the actuator units 82 and 83 corresponding to the nozzle groups 70 and 71 have trapezoid forms. However, other arrangement forms are also possible. For example, as shown in FIG. 7, triangular nozzle groups 90 and 92 and actuator units 91 and 93 may be used or, as shown in FIG. 8, trapezoid forms and triangular forms may be combined. Further still, although the actuator units 82, 83, 91 and 93 correspond to arrangement patterns of the piezoelectric elements 36 and have trapezoid forms or triangular forms, the present invention is not limited thus. Shapes of individual actuator units may be freely selected as long as spacings are formed between neighboring actuator units.

In the embodiment described above, the actuator units 82 and 83 are structured with the piezoelectric elements 36, the diaphragms 34 and the pressure chamber plates 32. However, the present invention is not limited thus. For example, structures in which the ink supply channel plate 30 is also added to the piezoelectric elements 36, the diaphragms 34 and the pressure chamber plate 32 may be used.

As a further example, ink discharge units may be structured by flow plate units and actuator units divided up in accordance with the nozzle groups 70 and 71, and these ink discharge units may be associated to constitute an inkjet recording head. With such a structure, discharge is possible at each ink discharge unit. Moreover, the gaps can be formed between the nozzle groups 70 and 71 as mentioned above, and thus the ink discharge units can be associated in the staggered pattern to structure the inkjet recording head. Accordingly, it is possible to lengthen the inkjet recording head without increasing the width of the inkjet recording head. Furthermore, if failures occur, the ink discharge units can be individually replaced.

As described above, the unit capable of discharging ink droplets of the present invention is preferably applied to an inkjet recording head. In contrast, in a case in which, as shown in FIG. 19, conventional inkjet recording heads 212 are assembled in a staggered pattern, the inkjet recording heads 212 must be offset to left and right as viewed along the row direction of the nozzles 10, so as not to overlap. Thus, in the case in which the inkjet recording heads 212 are put together in a staggered pattern to make a unit, width in a direction intersecting the rows of nozzles becomes wider, in addition to which there is a large amount of dead space between the heads in the row direction. As a result, this structure is not as worthwhile as the embodiment described above.

Further, in the embodiment described above, recording is carried out while the inkjet recording head 112 is conveyed by the carriage 104. However, the present invention is not limited thus. For example, an inkjet recording head at which nozzles are arranged over the whole width of the recording medium may be employed, with the inkjet recording head being fixed and recording being carried out while only the recording medium is conveyed. In such a case, the arrangement of the nozzles is rotated by 90°. That is, the direction M in FIG. 6 is the conveyance direction of the recording medium.

As a further example, in the embodiment described above, the actuator is constituted by the piezoelectric element 36. However, the present invention is not limited thus. For example, a heat-generating resistor which pressurizes ink in the pressure chamber by heating and causing bubbling may be used, or an element which utilizes electrostatic force, magnetic force or the like may be used. Alternatively, some other form of actuator may be used.

Further, inkjet recording in the present specification is not limited to recording text and images on recording paper. That is, a recording medium is not limited to paper, and a fluid that is ejected is not limited to ink. For example, it is possible to eject ink onto a polymer film, glass or the like to prepare a color filter for a display, to eject molten solder onto a substrate to prepare solder bumps for component packages, and the like. The present invention can be utilized generally for liquid droplet ejection devices used in industry.

According to the present invention as described hereabove, an inkjet recording head can be lengthened while assuring assembly characteristics and not increasing width of the inkjet recording head, and without causing a deterioration in yield.

What is claimed is:

1. An inkjet recording head which scans in a direction intersecting a conveyance direction of a recording medium and records an image on the recording medium with ink drops ejected from nozzles, the inkjet recording head comprising:

a nozzle plate in which the nozzles which eject the ink drops are formed;

pressure chambers communicating with the nozzles;

actuators abutting at the pressure chambers, which at least one of increase and reduce pressures of ink in the pressure chambers; and a plurality of nozzle rows parallel to the conveyance direction of the recording medium, wherein the inkjet recording head includes at least two nozzle groups which are grouped over a plurality of the nozzle rows, and each nozzle group is offset, relative to a neighboring nozzle group, in a direction intersecting a row direction of the nozzle rows such that the nozzle groups are arranged in a staggered form, and the numbers of nozzles in the nozzle rows of each nozzle group decrease in the direction intersecting the row direction, from the nozzle row at a side furthest from the neighboring nozzle group to the nozzle row at a side closest to the neighboring nozzle group.

2. The inkjet recording head of claim 1, wherein, when viewed in the row direction of the nozzle rows, the nozzles of the nozzle groups are disposed to line up in the row direction.

3. The inkjet recording head of claim 1, wherein arrangement forms of the nozzles of the nozzle groups comprise, when straight lines are taken between the nozzles disposed at outer edges of the nozzle groups, at least one of a triangular form and a trapezoid form.

4. The inkjet recording head of claim 3, wherein the arrangement forms of the nozzles of the nozzle groups include a combination of a plurality of forms including a triangular form and a trapezoid form.

5. The inkjet recording head of claim 1, wherein the inkjet recording head has an actuator unit for each nozzle group, the actuator unit being structured to include at least the pressure chambers and the actuators respectively corresponding to the nozzles constituting the nozzle groups.

6. The inkjet recording head of claim 5, wherein each nozzle group is provided with an ink discharge unit including at least the nozzle plate and the actuator unit.

7. The inkjet recording head of claim 1, wherein the actuators comprise piezoelectric elements for converting electrical energy to mechanical energy.

8. The inkjet recording head of claim 1, wherein the actuators comprise heat-generating resistors which pressurize the ink in the pressure chambers by heating and causing bubbling.

9. The inkjet recording head of claim 1, wherein the nozzle groups are disposed such that, when viewed in the row direction of the nozzle rows, the nozzles of all the nozzle groups that structure one side of the staggered-form arrangement are lined up in the row direction.

10. The inkjet recording head of claim 9, wherein the nozzle groups are disposed such that, when viewed in the row direction of the nozzle rows, the nozzles of all the nozzle groups that structure the other side of the staggered-form arrangement are lined up in the row direction.

11. An inkjet recording device employing the inkjet recording head of claim 1.

12. An inkjet recording head which records an image with ink drops ejected from nozzles over a width of a recording medium which is being conveyed, the inkjet recording head comprising:

a nozzle plate in which the nozzles which eject the ink drops are formed;

pressure chambers communicating with the nozzles;

actuators abutting at the pressure chambers, which at least one of increase and reduce pressures of ink in the pressure chambers; and a plurality of nozzle rows in a direction intersecting the conveyance direction of the recording medium, wherein the inkjet recording head includes at least two nozzle groups which are grouped over a plurality of the nozzle rows, and each nozzle group is offset, relative to a neighboring nozzle group, in a direction intersecting a row direction of the nozzle rows such that the nozzle groups are arranged in a staggered form, and the numbers of nozzles in the nozzle rows of each nozzle group decrease in the direction intersecting the row direction, from the nozzle row at a side furthest from the neighboring nozzle group to the nozzle row at a side closest to the neighboring nozzle group.

13. An inkjet recording device employing the inkjet recording head of claim 12.

14. An inkjet recording head which scans in a direction intersecting a conveyance direction of a recording medium and records an image on the recording medium with ink drops ejected from nozzles, the inkjet recording head comprising:

a nozzle plate in which the nozzles which eject the ink drops are formed;

pressure chambers communicating with the nozzles;

actuators abutting at the pressure chambers, which at least one of increase and reduce pressures of ink in the pressure chambers; and a plurality of nozzle rows parallel to the conveyance direction of the recording medium, wherein the inkjet recording head includes at least two nozzle groups which are grouped over a plurality of the nozzle rows, numbers of nozzles in the nozzle rows in a first of the nozzle groups decrease in one direction intersecting a row direction of the nozzle rows, numbers of nozzles in the nozzle rows in a second of the nozzle groups, which neighbors the first nozzle group in the row direction, decrease in a direction opposite to the one direction, and the first nozzle group and the second nozzle group are spaced apart in the row direction.

15. The inkjet recording head of claim 14, wherein numbers of nozzles in the nozzle rows in a third of the nozzle groups, which neighbors the second nozzle group in the row direction, decrease in the one direction, numbers of nozzles in the nozzle rows in a fourth of the nozzle groups, which neighbors the third nozzle group in the row direction, decrease in direction opposite to the one direction, the second, third and fourth nozzle groups are spaced apart in the row direction, and the second and fourth nozzle groups are arranged in a staggered form with respect to the first and third nozzle groups.

16. The inkjet recording head of claim 15, wherein, when viewed in the row direction of the nozzle rows, the nozzles of the first nozzle group are disposed so as to line up with the nozzles of the third nozzle group.

17. The inkjet recording head of claim 15, wherein, when viewed in the row direction of the nozzle rows, the nozzles of the second nozzle group are disposed so as to line up with the nozzles of the fourth nozzle group.

18. The inkjet recording head of claim 15, wherein, when viewed in the row direction of the nozzle rows, the nozzles of the nozzle groups are disposed to line up in the row direction.

19. An inkjet recording head which records an image with ink drops ejected from nozzles over a width of a recording medium which is being conveyed, the inkjet recording head comprising:

a nozzle plate in which the nozzles which eject the ink drops are formed;

pressure chambers communicating with the nozzles;

actuators abutting at the pressure chambers, which at least one of increase and reduce pressures of ink in the pressure chambers; and a plurality of nozzle rows in a direction intersecting the conveyance direction of the recording medium, wherein the inkjet recording head includes at least two nozzle groups which are grouped over a plurality of the nozzle rows, numbers of nozzles in the nozzle rows in a first of the nozzle groups decrease in one direction intersecting a row direction of the nozzle rows, numbers of nozzles in the nozzle rows in a second of the nozzle groups, which neighbors the first nozzle group in the row direction, decrease in a direction opposite to the one direction, and the first nozzle group and the second nozzle group are spaced apart in the row direction.

20. The inkjet recording head of claim 19, wherein numbers of nozzles in the nozzle rows in a third of the nozzle groups, which neighbors the second nozzle group in the row direction, decrease in the one direction, numbers of nozzles in the nozzle rows in a fourth of the nozzle groups, which neighbors the third nozzle group in the row direction, decrease in the direction opposite to the one direction, the second, third and fourth nozzle groups are spaced apart in the row direction, and the second and fourth nozzle groups are arranged in a staggered form with respect to the first and third nozzle groups.

21. The inkjet recording head of claim 20, wherein, when viewed in the row direction of the nozzle rows, the nozzles of the first nozzle group are disposed so as to line up with the nozzles of the third nozzle group.

22. The inkjet recording head of claim 20, wherein, when viewed in the row direction of the nozzle rows, the nozzles of the second nozzle group are disposed so as to line up with the nozzles of the fourth nozzle group.

23. The inkjet recording head of claim 20, wherein, when viewed in the row direction of the nozzle rows, the nozzles of the nozzle groups are disposed to line up in the row direction.

* * * * *